United States Patent [19]

Burgbacher et al.

[11] Patent Number: 4,909,711

[45] Date of Patent: Mar. 20, 1990

[54] SMALL FAN WITH ELECTRIC DRIVE MOTOR

[75] Inventors: Martin Burgbacher; Siegfried Harmsen; Georg Papst, all of St. Georgen, Fed. Rep. of Germany

[73] Assignee: Papst-Motoren GmbH & Co. KG, Mosbach-Waldstadt, Fed. Rep. of Germany

[21] Appl. No.: 786,118

[22] Filed: Oct. 10, 1985

Related U.S. Application Data

[63] Continuation of Ser. No. 502,196, Jun. 8, 1983, abandoned, which is a continuation of Ser. No. 12,027, Feb. 14, 1979, abandoned.

[30] Foreign Application Priority Data

Feb. 15, 1978 [CH] Switzerland ..... 1638/78

[51] Int. Cl.[4] ..... F04D 19/00; F04B 17/00

[52] U.S. Cl. ..... 417/354; 415/218.1; 415/219.1

[58] Field of Search ..... 417/354, 423 R, 423.1; 415/210, 211, 215, 218.1, 219.1

[56] References Cited

U.S. PATENT DOCUMENTS

| | | | |
|---|---|---|---|
| 2,522,675 | 9/1950 | Hoover | 415/213 B |
| 2,544,813 | 3/1951 | Wall | 415/215 |
| 2,629,330 | 2/1953 | Meline | 417/353 |
| 2,635,547 | 4/1953 | Cataldo | 417/423 R |
| 2,847,156 | 8/1958 | Bleier | 417/423 R |
| 2,991,927 | 7/1961 | Quick | 415/215 |
| 3,175,755 | 3/1965 | Rockafield | 417/354 |
| 3,260,443 | 7/1966 | Garnett et al. | 416/182 |
| 3,302,865 | 2/1967 | Kun | 417/423 R |
| 3,384,295 | 5/1968 | Haynes et al. | 417/354 |
| 3,502,030 | 3/1970 | Bukewillge et al. | 417/423 R |
| 3,515,498 | 6/1970 | Tomita . | |
| 3,584,968 | 6/1971 | Keith | 415/210 |
| 3,597,117 | 8/1971 | Zochfeld | 417/354 |
| 3,666,381 | 5/1972 | Ulm et al. | 417/423 R |
| 3,700,358 | 10/1972 | Papst et al. | 417/354 |

FOREIGN PATENT DOCUMENTS

| | | | |
|---|---|---|---|
| 717272 | 1/1932 | France . | |
| 968721 | 12/1950 | France | 417/354 |
| 810834 | 3/1959 | United Kingdom . | |
| 849744 | 7/1960 | United Kingdom . | |
| 858640 | 1/1961 | United Kingdom | 417/423 R |
| 1004677 | 9/1965 | United Kingdom . | |
| 1085565 | 10/1967 | United Kingdom . | |
| 1142732 | 2/1969 | United Kingdom . | |
| 1328082 | 8/1973 | United Kingdom | 417/423 R |

*Primary Examiner*—Leonard E. Smith

[57] ABSTRACT

A fan is disclosed comprising an electric drive motor having a shaft with an impeller coaxially disposed thereon, the impeller configured to suck axially and to blow with radial directional components and including a hub which is turned down over the motor, the hub having a rearward broad end that is turned away from the flow and presenting an outer generated surface that is symmetrical in rotation with reference to the motor axis, the outer generated surface being widened like a funnel in the direction of flow and inwardly defining an annular flow passage, and wherein blades are fastened to the hub along the generated surface. Further, in the disclosed fan the outer edges of the blades extend along a surface of rotation that is coaxial to the axis of the motor, the surface of rotation being constantly widened in the flow direction like a funnel, the widenings of the generated surface and the surface of rotation at least preponderantly having an opening angle that is less than 90°, the generated surface and surface of rotation being continuous and wherein the flow cross section in the flow passage between the surface of rotation and the generated surface increases in the direction of flow.

20 Claims, 9 Drawing Sheets

FIG.5
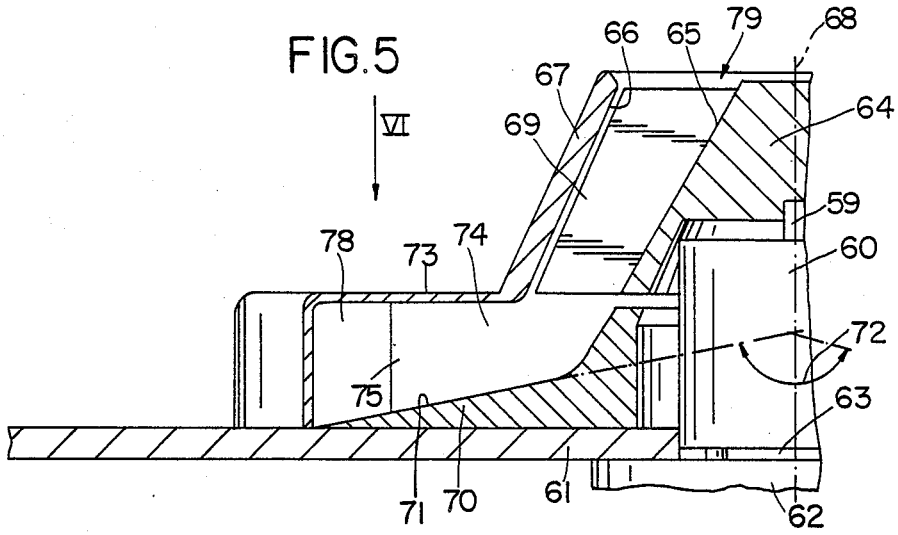
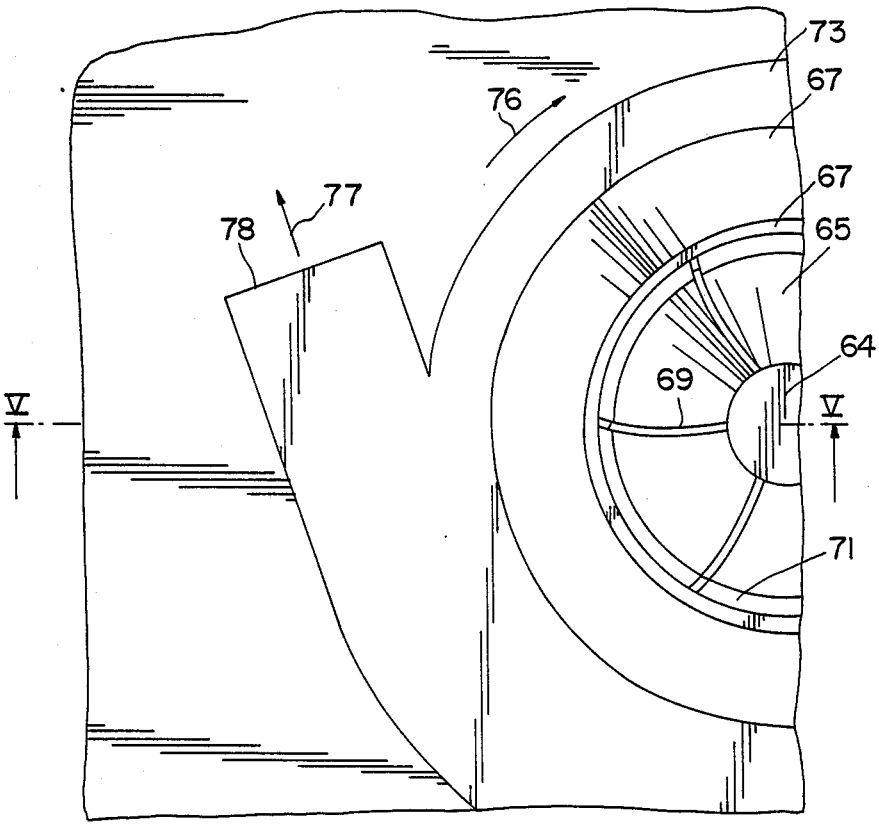
FIG.6

SMALL FAN WITH ELECTRIC DRIVE MOTOR

This is a continuation of abandoned application Ser. No. 502,196, filed June 8, 1983, which, in turn, is a continuation application of abandoned Ser. No. 012,027, filed Feb. 14, 1979.

BACKGROUND AND SUMMARY OF THE INVENTION

The present invention relates to a small fan with an electrical drive motor and an impeller coaxially disposed on the motor shaft, made to suck axially and blow with radial directional components, whose hub is turned down over the motor with its rearward broad end that is turned away from the flow, presenting an outer generated surface in rotational symmetry with respect to the motor axis, which is widened like a funnel in the direction of flow, defining the inside of an annular flow passage, in which the blades are fixed to the hub along the generated surface.

In a fan of this type known from German OS No. 19 24 611, the generated surface widens on the discharge side with an opening angle of 180° (degrees). This fan has the characteristic of a radial fan and can only be used as such.

Radial fans, in many practical operating conditions, have an especially high power requirement and correspondingly cause much noise, particularly in those cases in which because of their intrinsic type the motor rpm rises in a certain part of the characteristic curve. It is precisely in the case of domestic appliances mounted in connection with sheet walls that low-noise operation is important. This is true also for the ventilation of electrical instruments, e.g. data processing facilities, disposed in more or less standardized sheet cabinets, where there are stringent requirements for low noise. Different types of instruments that are to be ventilated by the same fan, as well as different operating points of one single fan can cause very different work points to appear on the fan characteristics line of a specific fan. Such different instruments may require high pressure and yet adequate delivery from the fan on the one hand, for example, and on the other hand in free blowing operating low noise in the case of the same fan may be required. Such contradictory requirements are unsatisfactorily met by known fans.

Thus, an object of the present invention is to develop a small fan of the aforementioned type that will combine the greatest possible number of advantages of a radial fan and an axial fan.

The present invention is characterized in that the outer edges of the blades extend along a surface of rotation coaxial to the motor axis, which surface constantly widens like a funnel in the direction of flow, in that the widenings of the generated surface and the surface of rotation have an opening angle less than 90° over the whole length, and are continuous, and in that the flow cross section in the flow passage between the surface of rotation and the generated surface does not narrow at any place in the direction of flow.

In small fans, motor output and therewith also the rpm depends upon the technological flow conditions of operation. This dependency is minimal over a relatively long portion of the fan characteristics line in fans according to the invention, whereby a multiplicity of possible applications is included.

As contrasted to known arrangements with radial impellers which need higher torques, the invention makes possible—aside from a reduction of drive power (or selectively a reduction of the size of the motor)—an optimal design of the motor in its efficiency because of the approximately given rpm constant over the characteristics line of the motor at this operational rpm (i.e. an additional improvements in efficiency or still further size reduction).

In the sense of noise reduction, the so-called diagonal fan of the present invention also offers advantages as contrasted to known devices, in the characteristics range that is utilized, and besides the possible power reductions in the motor can be exploited for noise reduction since a more efficient fan motor can run more slowly and hence more quietly with the same air output.

The fan according to the present invention, a so-called diagonal fan, can combine the specific advantages of axial fans (axial direction of delivery) and radial fans (axial suction flow, radial delivery, i.e. 90° deflection) and thereby afford further advantages in the intermediate range between the optimal range of the axial fan and that of the radial fan.

Thus a fan according to the present invention can run at rather high pressure in spite of the same voltage with about an unchanged rpm, or over the practically used charcteristics range it can accept about constant power, and in special cases the impeller according to the invention may even be of such design that it will run faster at high pressure than when it is free blowing.

There are advantageous flow conditions if the ratio of the flow cross section at the suction end of the flow passage between the surface of rotation and the generated surface to the flow cross section at the discharge end of this flow passage is 10:10 to 10:15, and preferably 10:13.

Flow can be enhanced by the configuration and shaping of the blades, e.g. by curving them so that they are convex or concave, as seen in the direction of rotation. Flow can also be enhanced by provision of an annular wall that encloses the flow passage and extends along the surface of rotation. Such an annular wall may be either stationary or rotating. If it is to rotate, it is fixed only to the impeller. The flow is more favorably guided, especially at the suction end, if the flow passage is enclosed at the outside by an annular wall that extends along the surface of rotation and that is thickened along its suction end by a protuberance that projects radially outward.

The small fan according to the present invention can be operated to blow out freely, hence with a blowing direction that is more or less an extension of the flow passage formed between the generated surface and the surface of rotation. However, the flow can also be deflected entirely or partly in a radial direction at the blowing side. A corresponding embodiment of the present invention is characterized in that the flow passage is enclosed at the outside by an annular wall that extends along the surface of rotation and projects beyond it on the discharge side, and is widened with its discharge end to an angle of opening that is substantially greater tan that of the surface of rotation, and with an opposed stationary flat deflector wall that is perpendicular to the axis of the motor forms an annular, radially outwardly open diffusor. Any undesired turbulence on the deflector wall can be reduced by disposition of a stationary deflector wall on the discharge side behind the hub, said wall widening in the direction of flow like a funnel, coaxially to the motor axis, with an opening angle that is substantially greater than that of the generated surface.

For the drive motor, an outside rotor motor with two poled stator, advantageously an asynchronous motor, is preferred. The stator can then be made so light that, at least for the major part, it can be disposed inside the axial length of the hub, and in this way the whole axial space requirement of the fan can be reduced.

It is advantageous to strive for a ratio of the core length (1) to the air gap diameter (d) of the drive motor to $\frac{1}{3}$ or more, especially in the case of a two-pole motor. A larger 1/d implies higher efficiency. Since however because of frequent axial limitation in construction, this is limited, and 1/d can only be increased if there is less motor power (as given in the invention, of course). A greater 1/d can be exploited in fans of the invention in a space-integrative way because the motor is weaker and therefore can have a smaller diameter. This is additionally advantageous with small rotor diameter, or it allows such diameter.

In specific cases, a fan according to the present invention, with use of an asynchronous motor for example, may have a softer characteristic, i.e. relatively high ohmic rotor resistance in free blowing at a relatively low rpm, delivering a specific amount of air, and with strong back pressure still delivering adequately and running quietly. This is managed by use of resistance-increasing alloy additives in the short circuit cage material (aluminum) of the driving rotor. The breakdown torque is then at a lower rpm, whereby the steepness of the stable range of the rpm characteristic line is less and the motor is softer, i.e. its regulatability to smaller rpm's is improved (e.g. with two pole motors, down to 1400 rpm (revolutions per minute). This additional regulatability is much desired in some cases.

BRIEF DESCRIPTION OF THE DRAWINGS

These and other objects, features and advantages of the present invention will become more apparent from the following description when taken in connection with the accompanying drawings which show, for purposes of illustration only, several embodiments in accordance with the present invention, and wherein:

FIG. 5 is the lefthand part of another embodiment of a small fan according to the present invention, in partial section;

FIG. 6 is a view in the direction of arrow VI of FIG. 5;

DETAILED DESCRIPTION OF THE DRAWINGS

Figure 1:
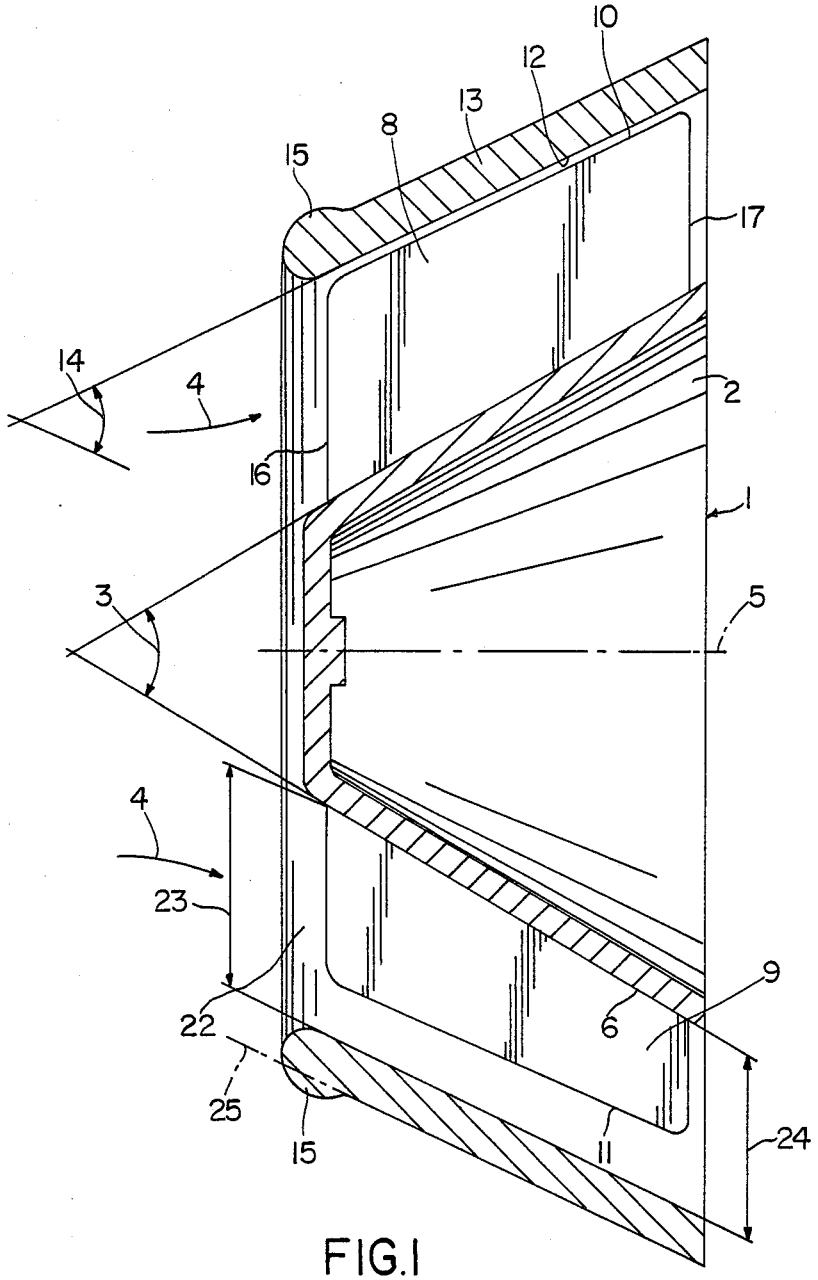
FIG. 1 shows the impeller of a first embodiment of the present invention with an annular wall in section, in operating position.
Figure 1A:
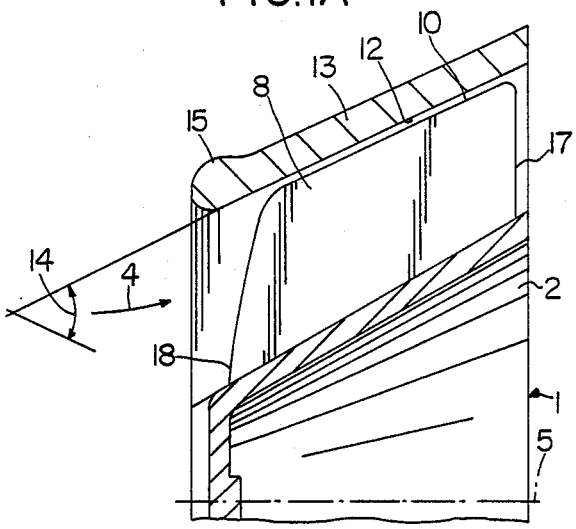
FIG. 1*a* is a partial view of an impeller as in FIG. 1 but with a modification of the blade edge configuration.
Figure 1B:
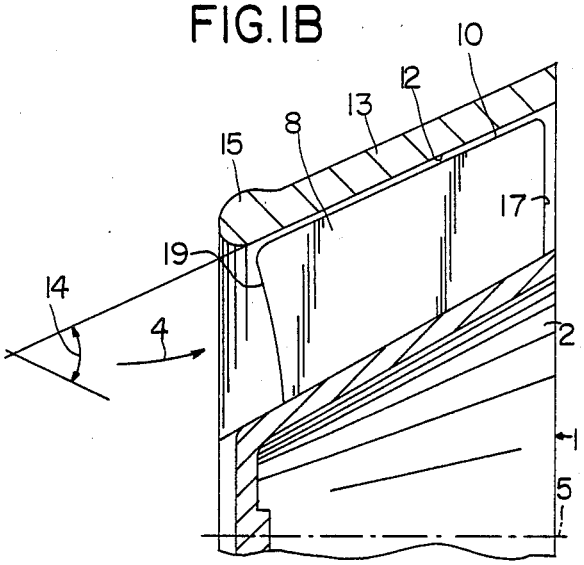
FIG. 1*b* is a partial view of an impeller as in FIG. 1 but with a modification of the blade edge configuration.
Figure 1C:
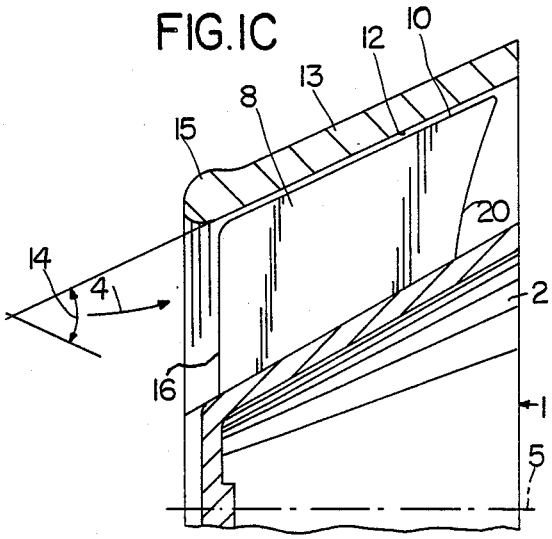
FIG. 1*c* is a partial view of an impeller as in FIG. 1 but with a modification of the blade edge configuration.
Figure 1D:
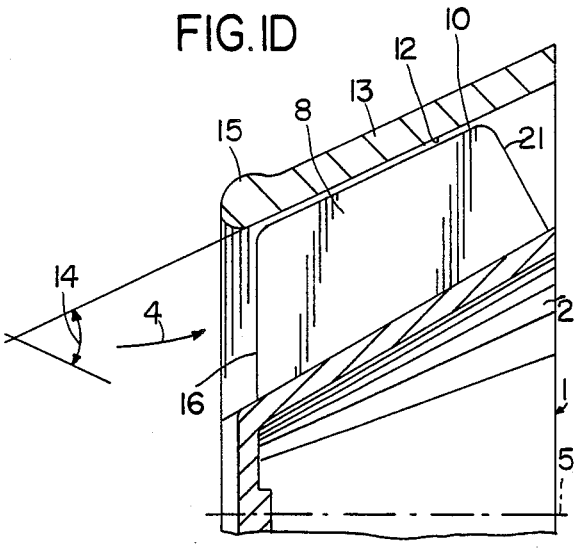
FIG. 1*d* is a partial view of an impeller as in FIG. 1 but with a modification of the blade edge configuration.

According to FIG. 1, numeral 1 generally designates the impeller whose hub 2 widens with an opening angle 3 of 60° in the direction of flow as indicated by arrow 4. The hub is in rotation symmetry with respect to rotation axis 5 and it is hollowed out at the broad end that is turned away from the flow (on the right in FIG. 1). To save space, the hub is turned down over the electric drive motor, which is not illustrated in FIG. 1. A total of seven blades 8, 9 are distributed on the periphery of generated surface 6, their radially outward edges 10, 11 extending with clearance along a surface of rotation 12 coaxial to axis 5. This surface of rotation 12 is the inside of a stationary annular wall 13 that is coaxial to axis 5, and it widens in the direction of flow with an opening angle 14 of 55°. Along the suction-side end there is a thickening protuberance 15 on annular wall 13 which extends outward and thereby enhances the flow. Flow passage 22 between generated surface 6 and surface of rotation 12 has the same flow cross section over its whole length. The outer generated surface 6 presented by the hub 2 is in the form of a truncated cone which is at least coextensive in length along the motor axis with the outer edges of the blades 8, 9 fastened to the hub as shown in FIG. 1. Edges 16 of blades 8, 9 that are turned toward the flow do not extend all the way to the suction-side end of the annular wall. Edges 16 and 17 of the blades extend radially. Modifications of the edges on a slant, corresponding to lines 18, 19, 20, 21 in FIGS. 1*a*–1*d* are advantageous i some situations. The annular flow cross section 23 at the suction end is as large as annular flow cross section 24 at the discharge end.

Figure 2:
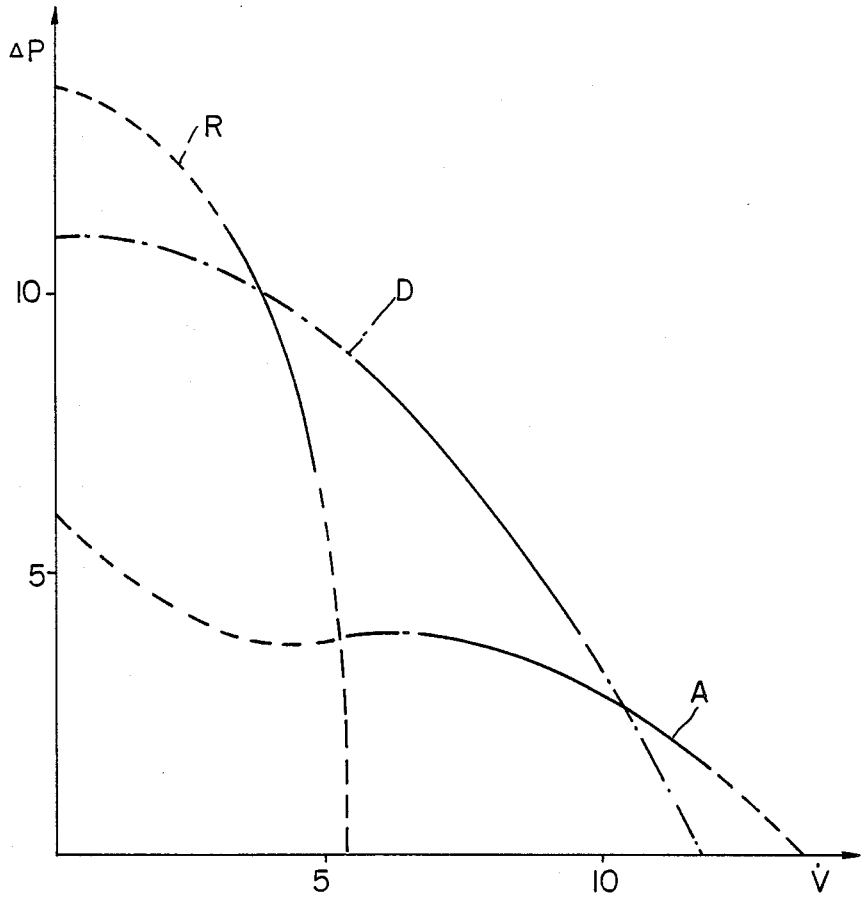
FIG. 2 is the characteristics diagram of delivery for the impeller of FIG. 1.

In FIG. 2 the elevation of pressure $\Delta p$ is plotted against the volume flow v. Curve R is a typical characteristic for a radial fan and curve A is a typical characteristic for an axial fan, while curve D is the characteristic of a fan according to the invention. In the drawing, those ranges within which the fan can be operated with good efficiency and low noise are indicated in solid lines and the other are in dashed lines.

The diagram of FIG. 2 shows that with the fan according to the invention it is possible to produce a broader range of use with respect to pressure elevation and volume flow, whereas radial fans are limited to a narrow range with respect to volume flow, and axial fans are confined to a narrow range with respect to pressure elevation in their practical application.

Figure 3:
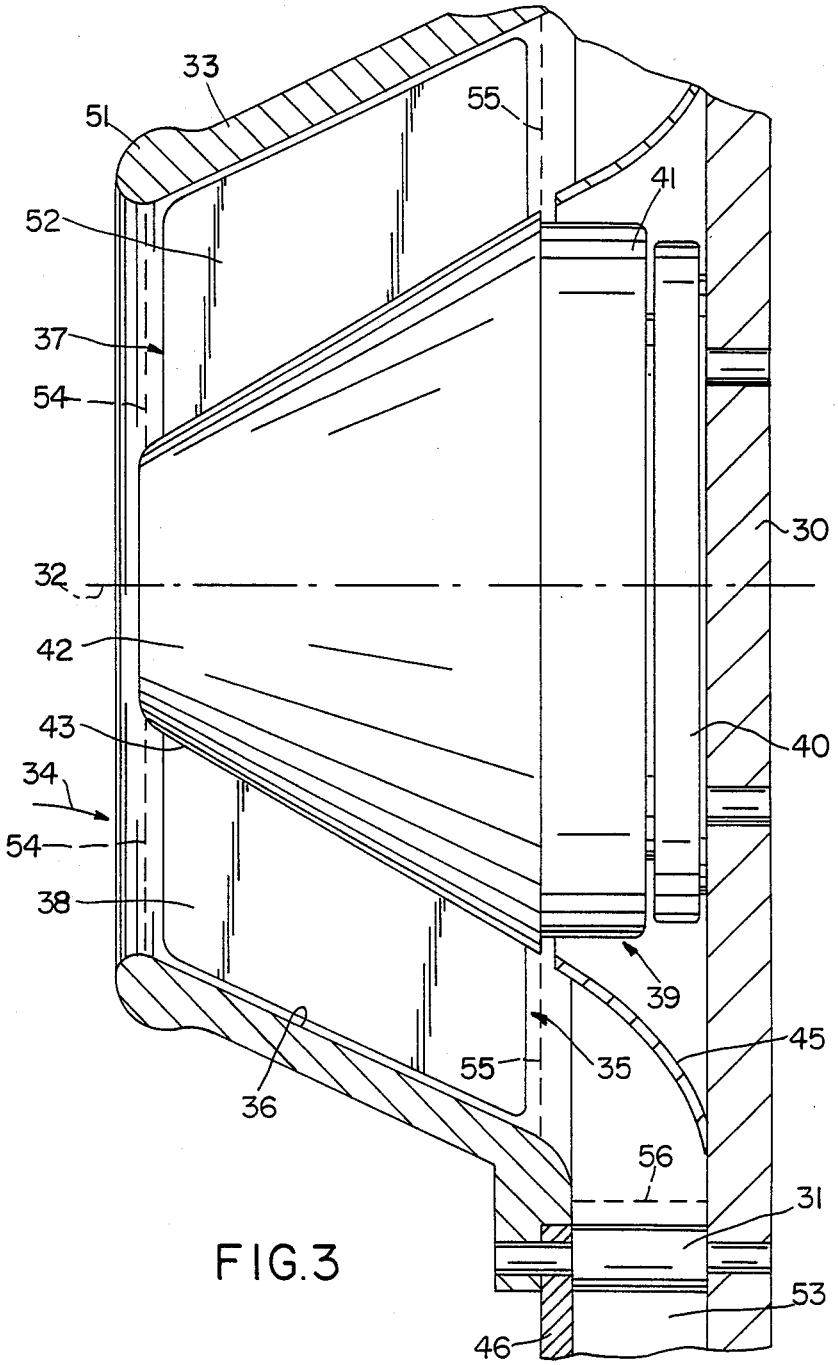
FIG. 3 is a small fan according to the invention, in partial section.

According to FIG. 3, numeral 30 designates a stationary deflector wall on which an annular wall 33 is fastened by bolts 31 distributed about the periphery, said wall being in rotation symmetry with respect to axis 32. The annular wall 33 widens in the flow direction indicated by arrow 34 to an opening angle that is less than 90°, its inner surface forming surface of rotation 36. Numeral 51 designates a protuberance corresponding to protuberance 15. Impeller 37 is borne coaxially to axis 32, its blades being designated 38 and 52. The blades of FIG. 3 that are turned toward the viewer are not drawn in, for the sake of clarity. Hub 42 is the rotor of an electric outside rotor motor 39, whose stator is designated 40. A part 41 of the rotor extends out of hub 42. A guide wall 45 that is curved with respect to axis 32 extends between generated surface 43 and deflector wall 30.

A diffusor wall 46 fixed to bolts 31 extends parallel to deflector wall 30. The flow passage 35 is annular, between generated surface 43 and surface of rotation 36. Blades 38 extend into this flow passage. To this there is connected an annular outwardly directed diffusor 53 which is limited on one side by diffusor wall 46 and on the other side by guide wall 45 and deflector wall 30, opening to the outside. The annular intake cross section along dashed line 54 is somewhat smaller than the annular discharge cross section of the flow passage along dashed line 55. Advantageously, the ratio of the intake cross section to the discharge cross section is 10:13. Fastening elements 31 stand in the flow and in some situations they are disturbing. They become unnecessary if diffusor wall 46 and annular wall 33 are attached in some other way in the indicated position opposite deflector wall 30, for example by fastening elements disposed at a distance. The annular cross section along line 56 is the same size as that along line 55.

Figure 3A:
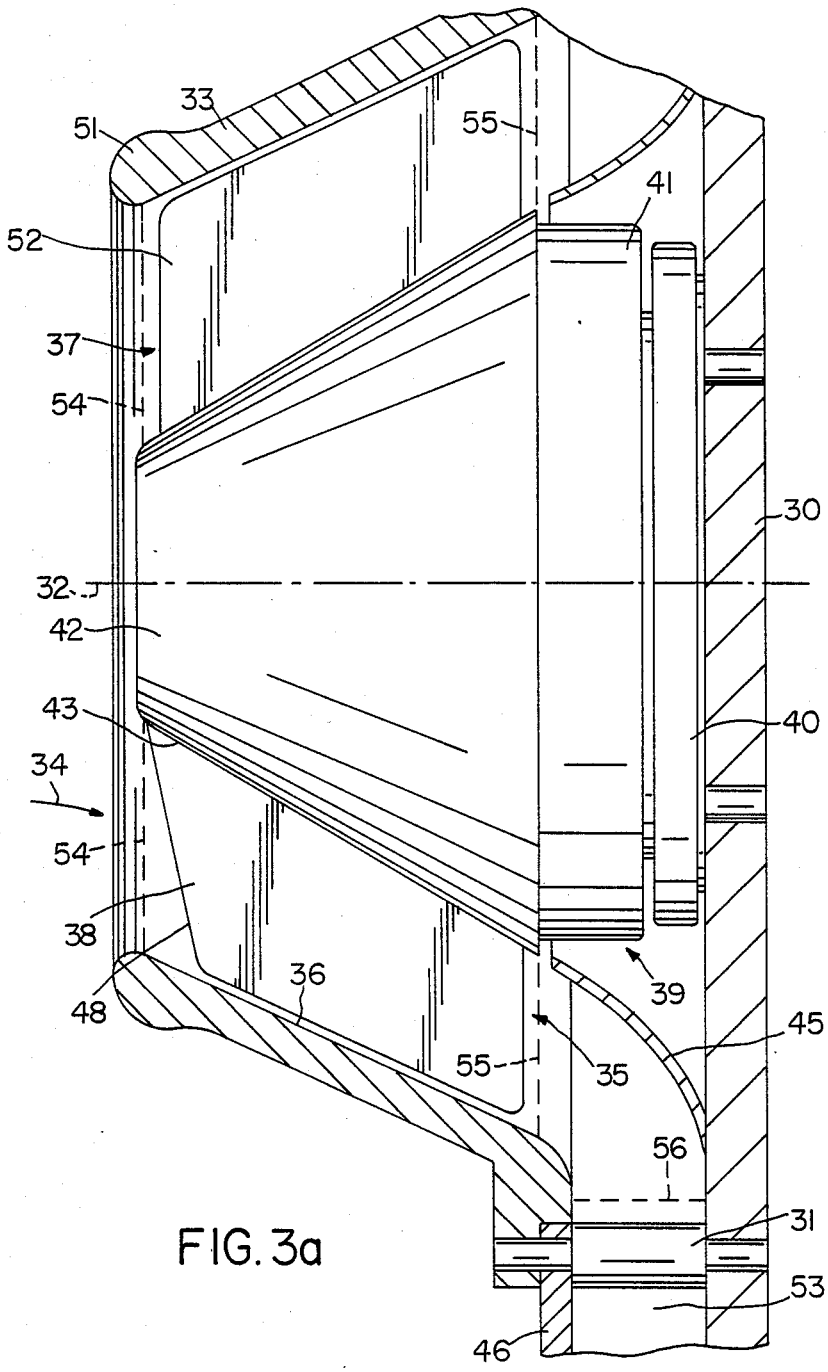
FIG. 3*a* shows a fan as in FIG. 3 but with a modification of the forward blade edge configuration.

Surface 45 guides the flow and forms a gentle continuous transition that is as free of bends as possible, from generated surface 43 into the surface of deflector wall 30. Line 48 indicates a modified forward edge of the blade edges as in FIG. 3*a*.

Figure 4:
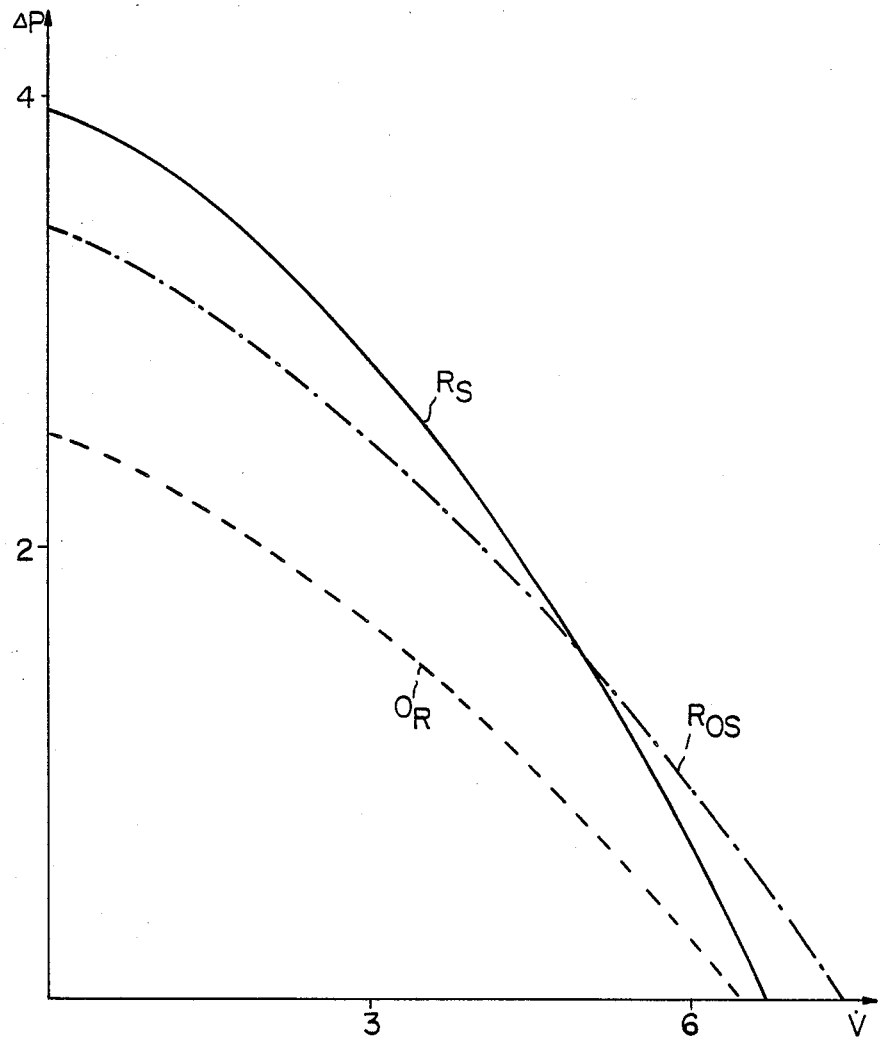
FIG. 4 is the diagram of the delivery characteristics for the embodiment according to FIG. 3.

In the diagram of FIG. 4, characteristic $O_R$ corresponds to the embodiment according to FIG. 1, driven to be free-blowing, hence without a diffusor. Characteristic $R_{OS}$ corresponds to the embodiment of FIG. 3 with diffusor, and characteristic $R_S$ corresponds to the embodiment to be described with reference to FIGS. 5 and 6.

In the example shown in FIGS. 5 and 6, motor 60 is an inside rotor motor fixed with a flange 62 to deflector wall 61, penetrating through a hole 63 in the deflector wall. Hub 64 is fixed to the shaft stump 59 of motor 60 and is partly turned down over the motor. The flow passage is limited by generated surface 65 and surface of rotation 66 of annular wall 67, which are disposed coaxially with reference to motor axis 68. Blades 69 extend into flow passage 79, being fixed to the hub along generated surface 65. The hub widens in the direction of flow with an opening angle of 85°, and the surface of rotation 66 widens with an opening angle of 83°. A deflector ring 70 is disposed behind hub 64, extending in the flow direction coaxially to axis 68 and widening with its deflector surface 71, with an opening angle 72 that is substantially larger than that of generated surface 65. Deflector surface 71 goes almost without a bend from the generated surface into the surface of deflector wall 61.

Flow passage 79 opens into an annular diffusor 74 that is limited on one side by a passage wall 73 and on the other side by deflector surface 71. The said diffusor 74 opens into a passage 75 which surrounds the whole fan, widening in the direction of rotation as indicated by arrow 76 and opening into a discharge opening 78 that is tangentially directed as indicated by arrow 77. The delivered air is blown out as indicated by arrow 77.

Figure 7:
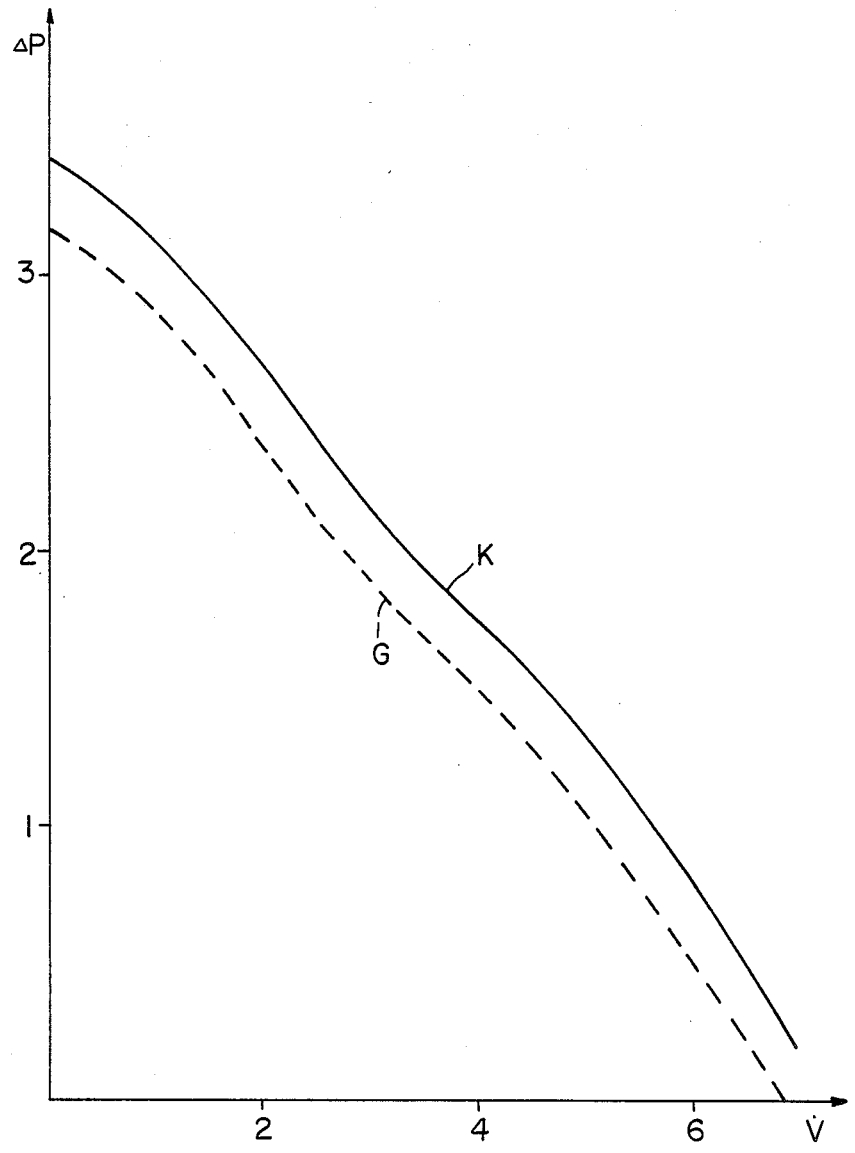
FIG. 7 is another diagram of delivery characteristics.

The blades in fans according to the present invention may be shaped or unshaped according to the circumstances, that is, for example, curved forward or backward or even planar. If the blades are convexly curved as seen in the direction of rotation a particularly high output is obtained but somewhat greater noise and a somewhat lower degree of efficiency has to be accepted, as indicated by characteristic K of FIG. 7. If on the contrary the blades are concave as seen in the direction of rotation, one can get a greater efficiency and somewhat less noise, but reduction in output has to be accepted, as shown in curve G of FIG. 7. Curve K was measured at 25 watts air output, an efficiency of 57% (percent) and a noise index of 64 decibels (A) at 2240 rpm. Curve G was measured with the same fan as characteristic K, where however the blades were exchanged for blades curved in the other direction. The efficiency then was 69% and a noise level of 62 decibels was measured at 2610 rpm. The test fan with which the measurements were made was driven by a two pole outside rotor asynchronous motor, and it was found that the indicated rpm remained unchanged over the whole portion of the characteristics line shown in FIG. 7.

It is advantageous, in conjunction with the invention with an outside rotor motor, to join the rotor with the impeller hub as a structural unit. This can be managed for example as shown in FIG. 8 or 9.

Figure 8:
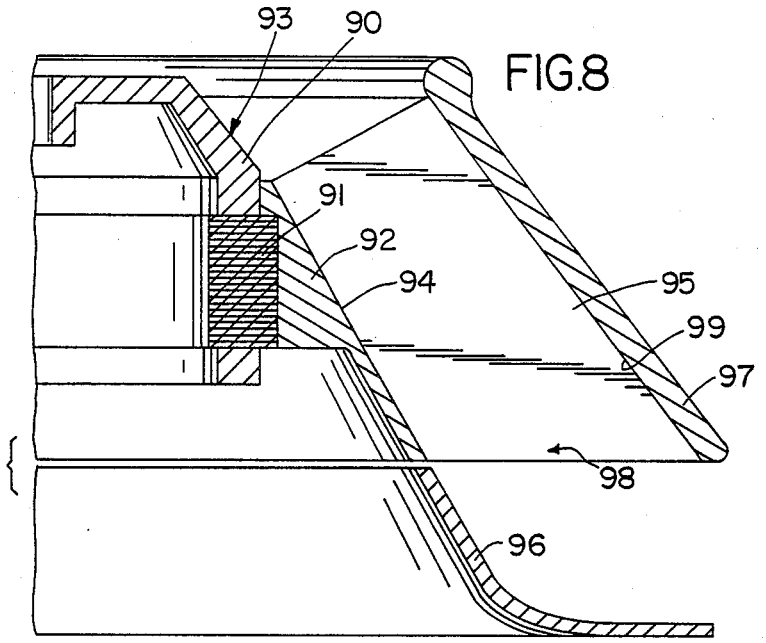
FIG. 8 is the righthand half of the impeller of another embodiment of a small an according to the present invention, with appurtenant deflector wall in section.
Figure 9:
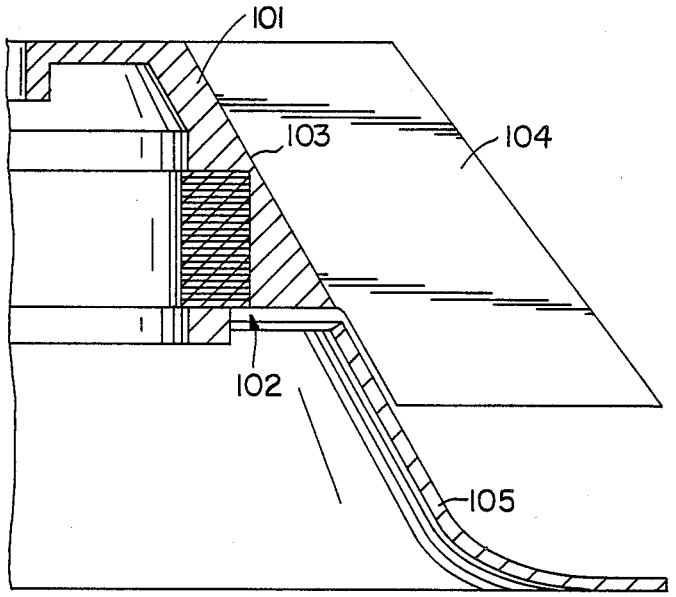
FIG. 9 is another embodiment of the impeller according to FIG. 8.

According to FIG. 8 the rotor of an outside rotor motor is designated 90. The sheet packet of the rotor is designated 91. A collar 92 is set on at the height of the sheet packet, said collar widening the outer contour of the rotor to that of hub 93 and forming generated surface 94 on which blades 95 are fastened.

In this embodiment an annular wall 97 is fixed on the outer edges of the blades for rotation therewith. Flow passage 98 extends between surface of rotation 99 formed by the inside of annular wall 97, and generated surface 94.

The stationary guide element 96 is connected to generated surface 94, deflecting the delivered flow in a radial direction. It is to be observed that the blades 95 only extend to the end of collar 92 and therefore the forward end of the hub 93 is free.

The situation is otherwise in the embodiment illustrated in FIG. 9, where rotor 101 of the outside rotor is made from the beginning in the form desired for hub 102 and constitutes generated surface 103 on which blades 104 are fixed. The blades extend with their discharge-side ends beyond hub 102 and reach into the region of guide wall 105 which moreover in this example also continues generated surface 103.

Blades 95 or 104 can be fixed to the hub by casting, welding or splining but they may also be fixed in a special retaining ring which in turn is fixed to the hub, e.g. thrust or splined onto it.

While we have shown several embodiments in accordance with the present invention, it is understood that the same is not limited thereto but is susceptible of numerous changes and modifications as known to those skilled in the art and we therefore do not wish to be limited to the details shown and described herein but intend to cover all such changes an modifications as encompassed by the scope of the appended claims.

We claim:

1. A small compact high efficiency fan delivering high pressure and volume flows at low noise levels that is equipped with an electric driving motor and an impeller wheel which has axial flow at the inlet and discharges with a radial component, the impeller wheel being fitted coaxially onto the motor shaft and consisting of a hub and blades that are fastened on the hub extending rearwardly from the inlet, the driving motor being an external rotor motor having a pot-shaped rotor that is at least partially enclosed by the hub to which the blades are attached, the hub being conically widened in the flow direction from the inlet toward the outlet along a shell surface extending coaxially to the motor shaft, the outside edges of the blades extending along a ring area which widens conically in the flow direction and extends coaxially to the motor shaft, an outer casing extending along said rim area and defining a flow duct between itself and the hub, the flow cross-sectional area, defined as the area between the ring area and the shell surface, at the intake side of a flow duct and the cross-sectional area at the outlet side being substantially constant, and wherein the rotor has one closed end located at the inlet side of the hub.

2. A fan according to claim 1, wherein the outside edges of the impeller wheel define an envelope enclosing the space between the ring surface and the shell surface.

3. A fan according to claim 1, wherein the flow cross-sectional area at the intake side of a flow duct, defined as the area between the ring area and the shell surface, and the flow cross-section at the outlet side are within a range of ratios to one another of 10:10 to 10:13.

4. A fan according to claim 1, wherein the flow cross-sectional area at the intake side of a flow duct, defined as the area between the ring and the shell surface, and the flow cross-section at the outlet side are within a range of ratios to one another of 10:10 to 10:15.

5. A fan according to claim 1, wherein a ring wall extends along the ring area and on the inlet end is thickened by an enlargement protruding radially toward tee outside.

6. A fan according to claim 1, wherein a ring wall extends along the ring area and is fastened only at the impeller wheel.

7. A fan according to claim 1, wherein the driving motor has a two-pole stator substantially arranged within the axial length of the hub.

8. A fan according to claim 1, wherein the hub is also the rotor of the external rotor motor.

9. A fan according to claim 1, wherein a stationary guiding element is provided at the end of the widened shell surface of the hub away from the inlet which deflects the delivered flow in a radial direction.

10. A fan according to claim 9, wherein the flow cross-sectional area at the intake side of a flow duct, defined as the area between the ring area and the shell surface, and the flow cross-section at the outlet side are within a range of ratios to one another of 10:10 to 10:13.

11. A fan according to claim 9, wherein the flow cross-sectional area at the intake side of a flow duct, defined as the area between the ring area and the shell surface, and the flow cross-section at the outlet side are within a range of ratios to one another of 10:10 to 10:15.

12. A fan according to claim 1, wherein the hub has a collar portion which forms part of the widening portion of the hub, said collar portion being fitted on a bundle of laminations of the driving motor and located in the flow direction at a point just before the laminations.

13. A fan according to claim 12, wherein the flow cross-sectional are at the intake side of a flow duct, defined as the area between the ring area and the shell surface, and the flow cross-section at the outlet side are within a range of ratios to one another of 10:10 to 10:13.

14. A fan according to claim 12, wherein the flow cross-sectional area at the intake side of a flow duct, defined as the area between the ring area and the shell surface, and the flow cross-section at the outlet side are within a range of ratios to one another of 10:10 to 10:15.

15. A fan according to claim 12, wherein a stationary guiding element is provided at the end of the widened shell surface of the hub away from the inlet which deflects the delivered flow in a radial direction.

16. A fan according to claim 12, wherein the widenings of the shell surface and the ring area each define a continuous straight line with an aperture angle that is smaller than 90 degrees, and wherein the flow cross-section located between the ring area and the shell surface does not become narrower in flow direction.

17. A fan according to claim 16, wherein the flow cross-sectional area at the intake side of a flow duct, defined as the area between the ring area and the shell surface, and the flow cross-section at the outlet side are within a range of ratios to one another of 10:10 to 10:13.

18. A fan according to claim 16, wherein the flow cross-sectional area at the intake side of a flow duct, defined as the area between the ring area and the shell surface, and the flow cross-section at the outlet side are within a range of ratios to one another of 10:10 to 10:15.

19. A fan according to claim 16, wherein the aperture angle of the shell surface is larger than that of the ring area and the shell surface as well as the ring surface are parts of conical surfaces.

20. A fan according to claim 19, wherein the flow cross-sectional area at the intake side of a flow duct, defined as the area between the ring and the shell surface, and the flow cross-section at the outlet side are within a range of ratios to one another of 10:10 to 10:15.

* * * * *

UNITED STATES PATENT AND TRADEMARK OFFICE

CERTIFICATE OF CORRECTION

PATENT NO. : 4,909,711

DATED : March 20, 1990

INVENTOR(S) : MARTIN BURGBACHER, et al.

It is certified that error appears in the above-identified patent and that said Letters Patent is hereby corrected as shown below:

(Column 7, line 7)
Change "RIM" to --Ring--

Signed and Sealed this

Twenty-fifth Day of May, 1993

*Attest:*

Michael K. Kirk

MICHAEL K. KIRK

*Attesting Officer*

*Acting Commissioner of Patents and Trademarks*